US008365711B2

(12) United States Patent
Kusiak et al.

(10) Patent No.: US 8,365,711 B2
(45) Date of Patent: Feb. 5, 2013

(54) BALL FEEDING DEVICE FOR A BALL PITCHING MACHINE AND METHOD OF USING THE SAME

(76) Inventors: Mark Kusiak, Taylor, MI (US); Leon Woods, Whitehouse, OH (US)

( * ) Notice: Subject to any disclaimer, the term of this patent is extended or adjusted under 35 U.S.C. 154(b) by 243 days.

(21) Appl. No.: 12/759,102

(22) Filed: Apr. 13, 2010

(65) Prior Publication Data

US 2010/0258100 A1 Oct. 14, 2010

Related U.S. Application Data

(60) Provisional application No. 61/212,625, filed on Apr. 14, 2009.

(51) Int. Cl.
*F41B 4/00* (2006.01)

(52) U.S. Cl. ..... 124/6; 124/49

(58) Field of Classification Search ..... 124/6, 41.1, 124/45, 49, 50, 78; 221/260, 267, 307, 310
See application file for complete search history.

(56) References Cited

U.S. PATENT DOCUMENTS

| | | | | | |
|---|---|---|---|---|---|
| 1,955,559 | A * | 4/1934 | Narrow | 221/309 |
| 2,294,001 | A * | 8/1942 | Ritter | 206/537 |
| 2,857,794 | A * | 10/1958 | Red, Jr. | 81/64 |
| 3,189,222 | A * | 6/1965 | Smalley | 221/220 |
| 3,206,067 | A * | 9/1965 | Smith, Jr. et al. | 221/281 |
| 3,412,897 | A * | 11/1968 | Slater | 221/226 |
| 4,091,791 | A * | 5/1978 | Castelli et al. | 124/73 |
| 5,437,261 | A | 8/1995 | Paulson et al. | |
| 5,832,909 | A | 11/1998 | Grant et al. | |
| 6,089,217 | A | 7/2000 | Paulson et al. | |
| 6,164,271 | A | 12/2000 | Paulson et al. | |
| 6,672,297 | B1 | 1/2004 | Liao | |
| 6,732,724 | B1 | 5/2004 | Paulson et al. | |
| 6,739,325 | B1 | 5/2004 | Paulson | |
| 7,290,540 | B2 | 11/2007 | Lu | |
| 7,321,913 | B2 | 1/2008 | McGrath | |
| 2002/0134367 | A1 | 9/2002 | Delso | |

* cited by examiner

*Primary Examiner* — John Ricci
(74) *Attorney, Agent, or Firm* — Howard & Howard Attorneys PLLC

(57) ABSTRACT

A device for attachment to a chute of a ball pitching machine includes a ball feeder tube having a first end for receiving a first ball. A retaining member is fixed relative to the ball feeder tube and extends transversely to the ball feeder tube into the bore for selectively retaining the first ball in the bore. The retaining member is resiliently deformable toward the ball feeder tube for allowing the first ball to move past the retaining member toward the chute upon application of a predetermined force on the first ball. The ball feeder tube defines a bore having a diameter. The retaining member is spaced along the bore a first distance from the first end. The first distance is shorter than the diameter of the bore so that insertion of a second ball into the first end with the predetermined force displaces the first ball toward the chute.

19 Claims, 7 Drawing Sheets

BALL FEEDING DEVICE FOR A BALL PITCHING MACHINE AND METHOD OF USING THE SAME

CROSS-REFERENCE TO RELATED APPLICATIONS

The subject patent application claims priority to and all the benefits of U.S. Provisional Patent Application No. 61/212,625 which was filed on Apr. 14, 2009, the entire specification of which is expressly incorporated herein by reference.

BACKGROUND OF THE INVENTION

1. Field of the Invention

The present invention relates to a device for attachment to a chute of a ball pitching machine for selectively retaining a ball and selectively delivering the ball to the chute and a method of using the device.

2. Description of the Related Art

Ball pitching machines are widely used for practicing batting in the game of softball and baseball. Pitching machines include a wheel that rotates to propel the ball from the pitching machine toward a batter. A chute is typically disposed adjacent the wheel for receiving the ball and delivering the ball to the spinning wheel.

In a real game situation, a pitcher moves through a pitching motion, which typically includes a wind-up and a delivery. The batter adjusts swing timing and rhythm based on the pitcher's pitching motion in order to make contact with the ball. However, during batting practice with current ball pitching machines, a person stands next to the pitching machine and drops the ball in the chute whereby the pitching machine propels the ball toward the batter. The motion of the person dropping the ball into the chute does not simulate the pitching motion of the pitcher. As such, the batter cannot practice adjusting swing timing and rhythm based on a pitcher's pitching motion during practice with current pitching machines.

As such, it would be advantageous to develop a pitching machine and a method of using the pitching machine to simulate the pitching motion of a pitcher such that the batter can practice swinging in view of the pitching motion.

SUMMARY OF THE INVENTION AND ADVANTAGES

The present invention includes a ball pitching machine for propelling a ball. The ball pitching machine comprises a frame and at least one wheel rotatably coupled to the frame for rotatably contacting the ball to propel the ball. A ball feeder tube has a first end spaced from the wheel for receiving the ball and defines a bore extending from the first end toward the wheel for delivering the ball to the wheel. A retaining member is fixed relative to the ball feeder tube and extends transversely to the ball feeder tube into the bore between the first end and the wheel for selectively retaining the ball spaced from the wheel in the bore. The retaining member is resiliently deformable toward the ball feeder tube for allowing the ball to move past the retaining member toward the wheel upon application of a predetermined force on the ball.

The present invention also includes a device for attachment to a chute of a ball pitching machine for selectively retaining a ball and selectively delivering the ball to the chute. The device comprises a ball feeder tube having a first end for receiving the ball and a second end for attachment to the chute. The ball feeder tube defines a bore having a diameter and extending from the first end to the second end for delivering the ball to the chute. A retaining member is fixed relative to the ball feeder tube and extends transversely to the ball feeder tube into the bore between the first end and the second end for selectively retaining the ball in the bore. The retaining member is resiliently deformable toward the ball feeder tube for allowing the ball to move past the retaining member toward the chute upon application of a predetermined force on the ball. The retaining member is spaced along the bore a first distance from the first end. The first distance is shorter than the diameter of the bore so that insertion of a second ball into the first end with the predetermined force displaces the ball toward the chute.

The present invention also includes a method of feeding a ball into a ball pitching machine having a rotatable wheel, a ball feeder tube having a first end spaced from the wheel, and a retaining member fixed relative to the ball feeder tube between the first end and the wheel. The method comprises inserting a first ball into the first end of the ball feeder tube and into engagement with the retaining member. The method also comprises moving a second ball through a simulated pitching motion. The method also comprises inserting the second ball into the first end of the ball feeder tube during the simulated pitching motion to displace the first ball from the retaining member toward the wheel to project the first ball from the ball pitching machine.

Since the retaining member advantageously retains the first ball in the bore ready for release toward the wheel, the second ball can be moved through the simulated pitching motion while the first ball remains ready for release. Further, since the first ball is displaced from the retaining member by merely inserting the second ball into the first end of the bore with the predetermined force, the second ball can be inserted into the first end during the simulated pitching motion to release the first ball toward the wheel. Advantageously, because the second ball is moved through the simulated pitching motion and displaces the first ball during the simulated pitching motion, the first ball is propelled toward the batter during the simulated pitching motion to simulate an actual pitch during an actual game. The batter can practice adjusting swing timing and rhythm based on the simulated pitching motion. As such, the batter is better able to practice for actual game situations involving an actual pitchers moving through pitching motions to deliver a ball to the batter.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate like parts throughout the several views, a ball pitching machine 10 for propelling a ball is generally shown at 10. The ball pitching machine 10 is of the type that is used, for example, to practice batting in the game of softball or baseball. As shown in FIGS. 1 and 10A-C, the ball pitching machine 10 is loaded with a ball 12 and the ball 12 is propelled toward a batter (not shown) to simulate a pitcher pitching the ball 12 to the batter.

Figure 1:
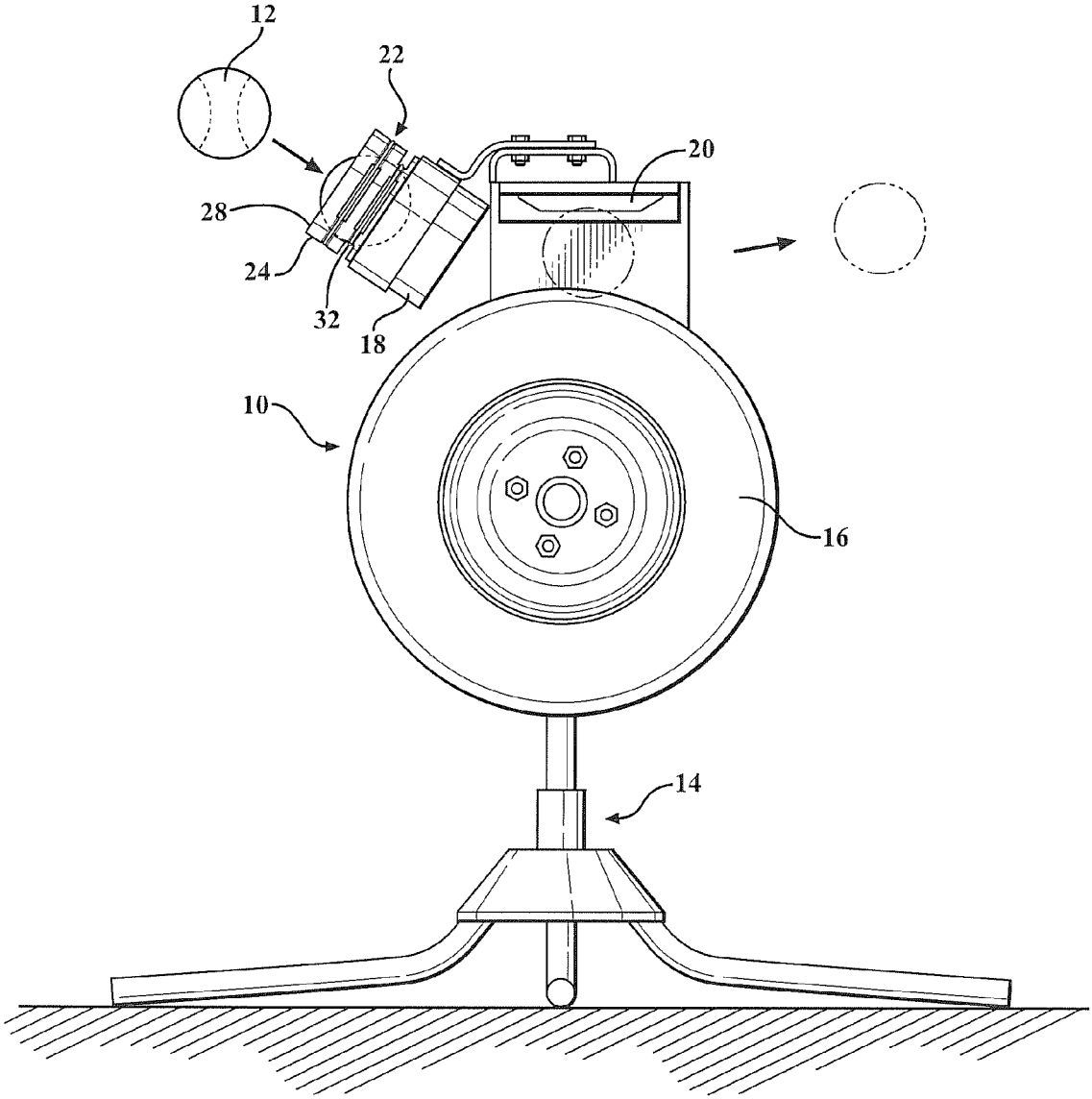
FIG. 1 is a side view of a ball pitching machine.
Figure 2:
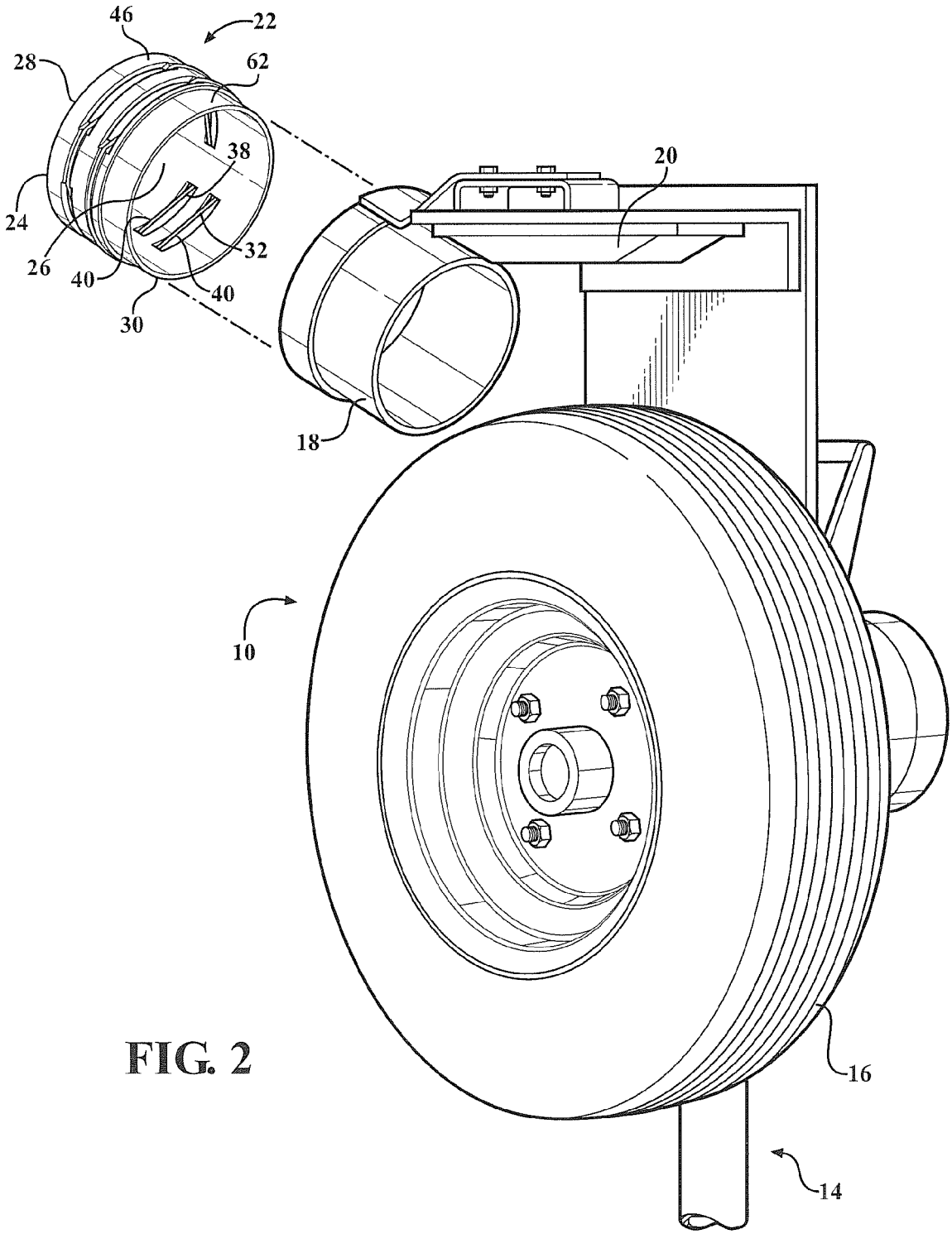
FIG. 2 is a perspective view of a portion of the ball pitching machine.

With reference to FIGS. 1 and 2, the ball pitching machine 10 typically includes a frame 14 and at least one wheel 16 rotatably coupled to the frame 14 for rotatably contacting the ball 12 to propel the ball 12. The ball pitching machine 10 shown in FIGS. 1 and 2 includes one wheel 16. Alternatively, the ball pitching machine 10 can include two or more wheels for propelling the ball 12.

A chute 18 is typically supported by the frame 14 adjacent the wheel 16 for receiving the ball 12 and delivering the ball 12 to the wheel 16. A cover plate 20 is typically mounted adjacent the wheel 16 for holding the ball 12 against the wheel 16 and for aiming the ball 12. It should be appreciated that the ball pitching machine 10 of FIGS. 1 and 2 is shown for exemplary purposes and the ball pitching machine 10 can be of any type without departing from the nature of the present invention.

Figure 3:
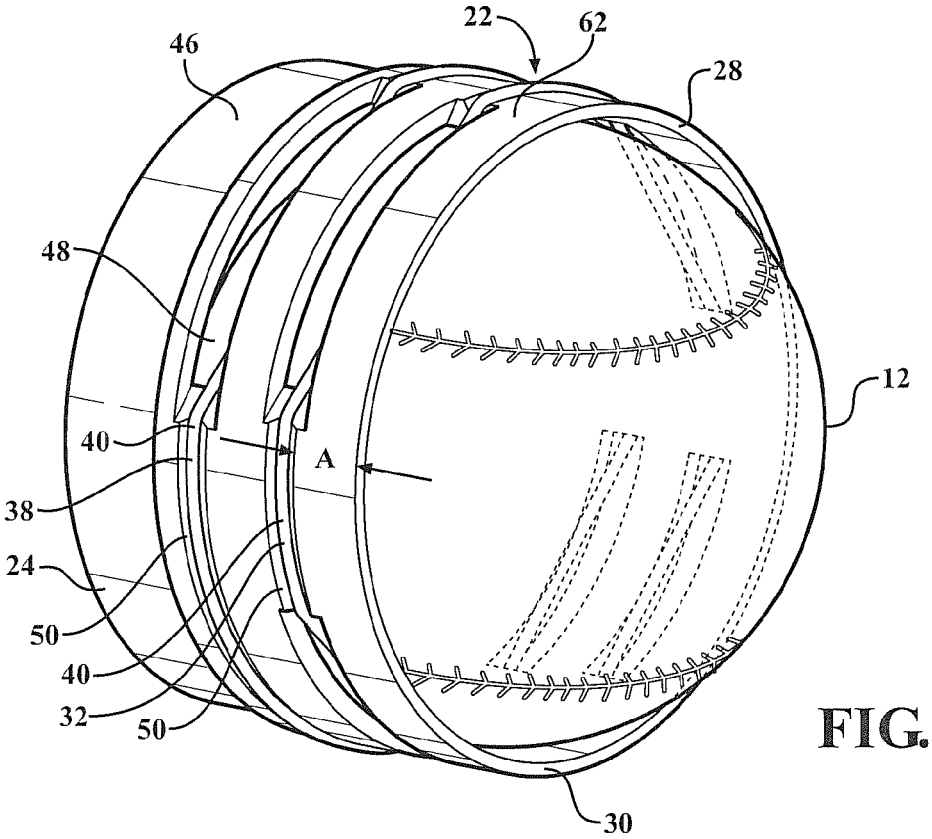
FIG. 3 is a perspective view of a device for attachment to a chute of the ball pitching machine including a ball engaged in the device.
Figure 4:
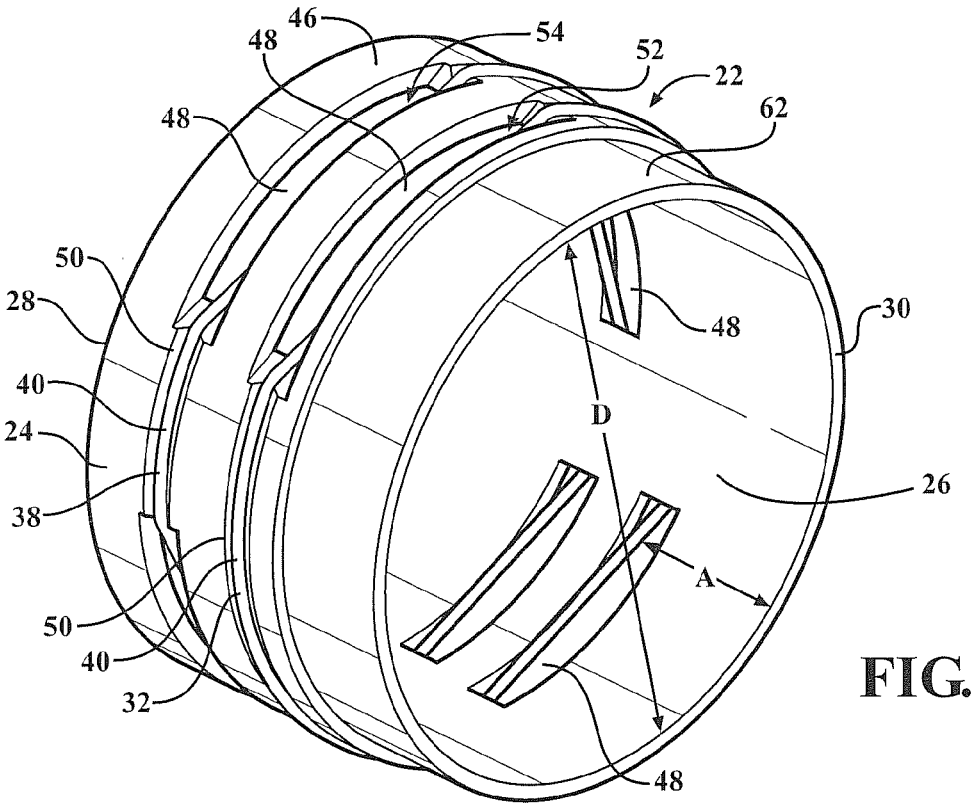
FIG. 4 is another perspective view of the device of FIG. 3.
Figure 5:
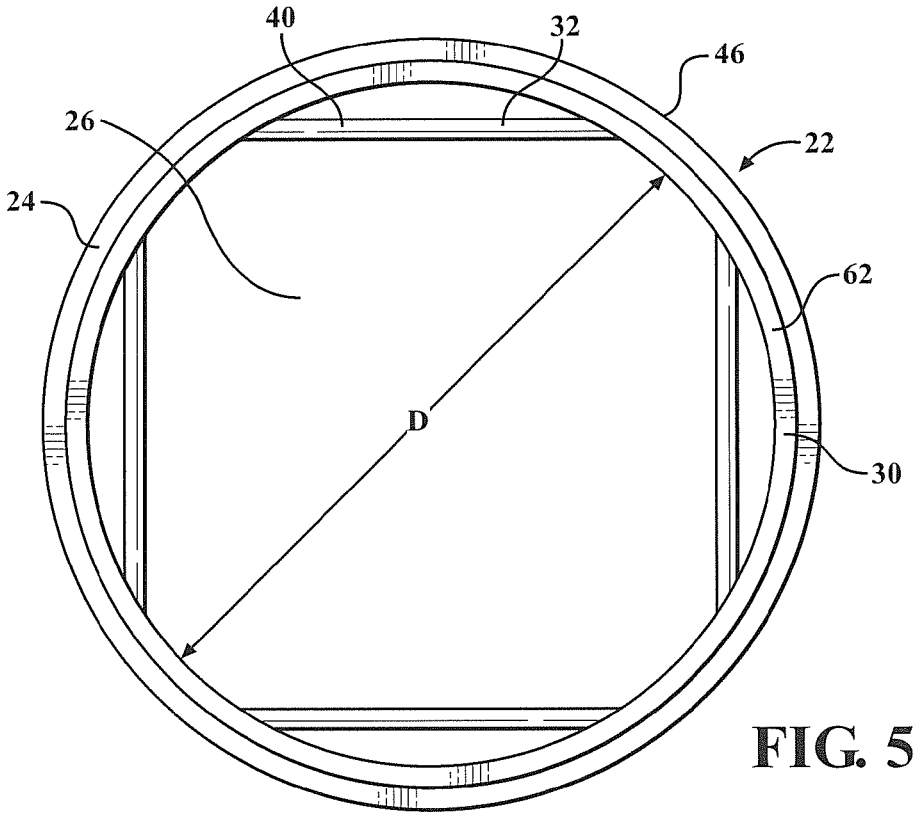
FIG. 5 is an end view of the device of FIG. 3.
Figure 6:
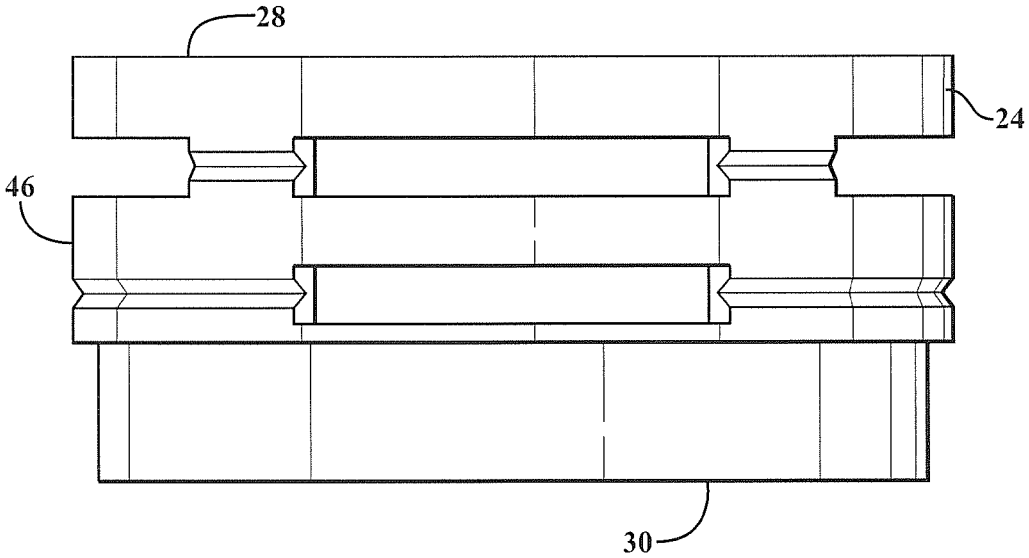
FIG. 6 is a top view of the device of FIG. 3.
Figure 7:
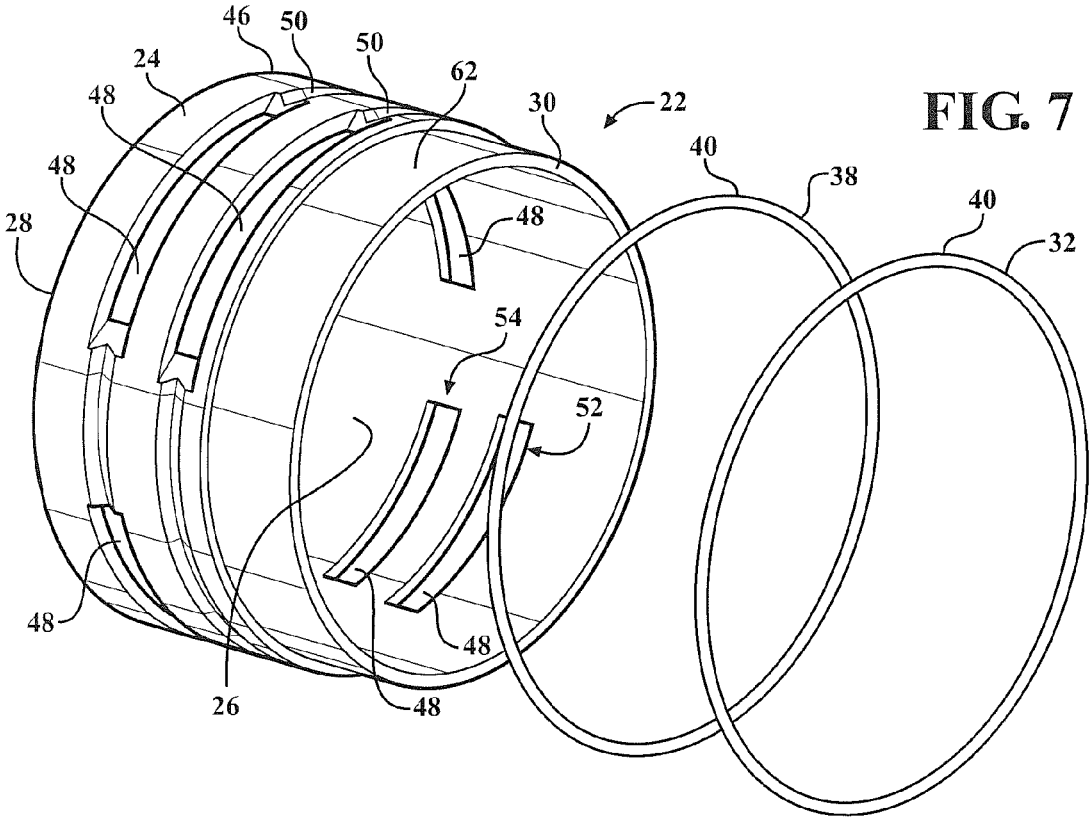
FIG. 7 is an exploded view of the device of FIG. 3.

As best shown in FIG. 2, a device 22 is attached to the chute 18 of the ball pitching machine 10 for selectively retaining the ball 12 and selectively delivering the ball 12 to the chute 18. With reference to FIGS. 3 and 4, the device 22 includes a ball feeder tube 24 defining a bore 26 and a retaining member 32 extending into the bore 26. With reference to FIG. 3, the bore 26 receives the ball 12 and the retaining member 32 selectively retains the ball 12 in the bore 26, as discussed further below.

It should also be appreciated that the term "ball" is used herein to describe any type of ball. The device 22 and the ball pitching machine 10 can be dimensioned to accommodate any type of ball, such as, but not limited to softballs and baseballs. It should also be appreciated that the device 22 is also capable of accommodating practice softballs/baseballs such as, for example, hollow plastic balls, dimpled balls, etc., in addition to standard softballs and baseballs.

The ball feeder tube 24 has a first end 28 spaced from the wheel 16 for receiving the ball 12 and a second end 30 spaced from the first end 28 between the first end 28 and the chute 18 for attachment to the chute 18. The bore 26 of the ball feeder tube 24 has a diameter D and extends from the first end 28 to the second end 30 for delivering the ball 12 to the chute 18. In other words, the bore 26 extends from the first end 28 toward the wheel 16 for delivering the ball 12 to the wheel 16.

The second end 30 of the ball feeder tube 24 is configured to removeably engage the chute 18, i.e., the ball feeder tube 24 can be formed separately from the chute 18 and subsequently assembled to the chute 18 and can be selectively removed from the chute 18. In such a scenario, the ball feeder tube 24 can retrofit an existing pitching machine. The ball feeder tube 24 can include a nozzle 62 for insertion into the chute 18 to assemble the ball feeder tube 24 to the chute 18. The nozzle 62 typically has a decreased outer diameter for insertion into the chute 18. Alternatively, the nozzle 62 can have an increased inner diameter for insertion over the chute 18. The nozzle 62 can be retained in the chute 18 in any fashion such as, for example, gravity, friction fit, adhesive, set screw, etc. Alternatively, the device 22 can be integrated with the chute 18 of the ball pitching machine 10, i.e., the ball feeder tube 24 and the chute 18 can be manufactured together as a one-piece construction, or The bore 26 of the ball feeder tube 24 is dimensioned to receive the ball 12 so that the ball can freely roll along the bore 26 when unobstructed, e.g., when unobstructed by the retaining member 32 and the second retaining member 38 discussed further below. The ball feeder tube 24 shown in the Figures is cylindrical. However, it should be appreciated that the ball feeder tube 24 can be of any shape without departing from the nature of the present invention. It should also be appreciated that the ball feeder tube 24 need not circumferentially surround the ball, i.e., the ball feeder tube 24 can be open or trough-shaped.

A retaining member 32 is fixed relative to the ball feeder tube 24 and extends transversely to the ball feeder tube 24 into the bore 26 between the first end 28 and the wheel 16, and typically between the first end 28 and the second end 30, for selectively retaining the ball 12 spaced from the wheel 16 in the bore 26. The retaining member 32 is resiliently deformable toward the ball feeder tube 24 for allowing the ball 12 to move past the retaining member 32 toward the chute 18, i.e., toward the wheel 16, upon application of a predetermined force on the ball 12. In other words, when at rest, the retaining member 32 is positioned in the bore 26 in a retaining position and, upon application of the predetermined force, the retaining member 32 is deformed toward the ball feeder tube 24 by the ball 12. In other words, the retaining member 32 is deformed outwardly relative to the bore 26.

The retaining member 32 is deformed such that the ball 12 can move past the retaining member 32 toward the second end 30. Once past the retaining member 32, the ball 12 can freely move toward the wheel 16 to be propelled from the ball pitching machine 10 by the wheel 16. Because the retaining member 32 is resilient, the retaining member 32 returns to the retaining position after the ball 12 is moved away from the retaining member 32. For example, the retaining member 32 is shown in the retaining position in FIGS. 4-5 and 8-9. Typically the predetermined force required to resiliently deform the retaining member 32 is large enough so that a first ball 34 is firmly retained in the bore 26 and small enough that a second ball 36 can easily inserted into the bore 26 in a fluid motion to displace the first ball 34 from the retaining member 32, as discussed further below. The predetermined force can, for example, have a magnitude of 0.5-5 pound-force.

Figure 9:
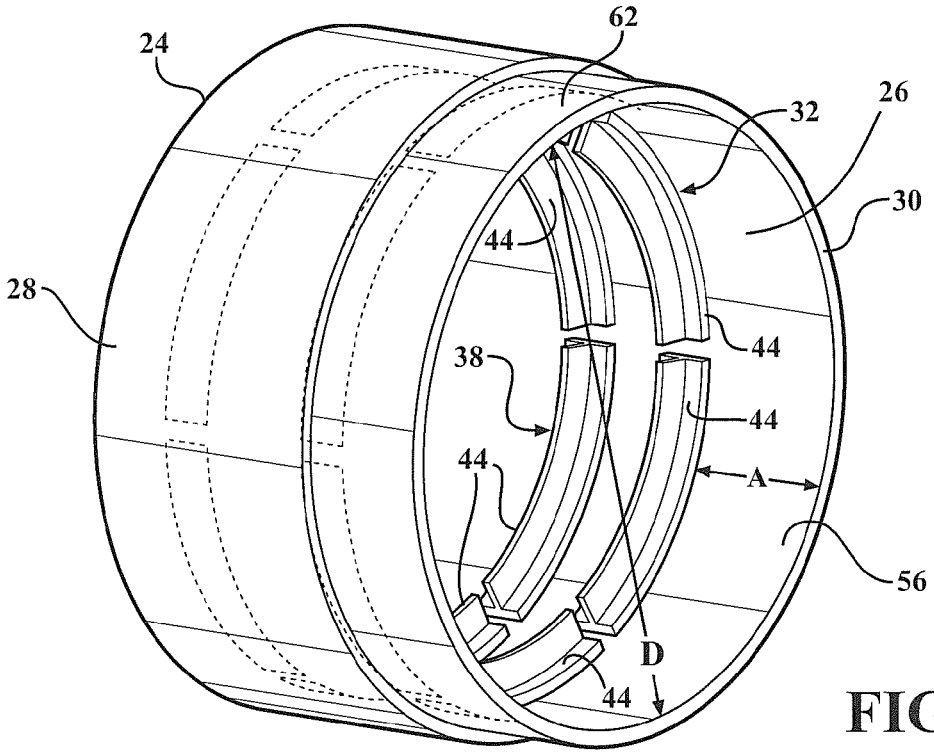
FIG. 9 is a perspective view of a third embodiment of the device.

The retaining member 32 is typically disposed circumferentially about the ball feeder tube 24 in the bore 26. The retaining member 32 can be spaced about the bore 26, i.e., extending into the bore 26 at spaced intervals, as best shown in FIGS. 4 and 9. For example, the retaining member 32 can be continuous and extend into the bore 26 at spaced intervals, as best shown in FIG. 4 and set forth further below. Alternatively, the retaining member 32 can be discontinuous and disposed at spaced intervals about the bore 26, as best shown in FIG. 9 and set forth further below. Alternatively, the retaining member 32 can be continuous and disposed in the bore 26 to continuously extend about the bore 26.

Typically, a second retaining member 38 is fixed relative to the ball feeder tube 24 and extends transversely to the ball feeder tube 24 into the bore 26. The second retaining member 38 is spaced between the retaining member 32 and the first end 28 for selectively retaining the ball 12 between the retaining member 32 and the second retaining member 38 until application of the predetermined force on the ball 12. The second retaining member 38 is typically shaped similarly to the retaining member 32. Alternatively, the second retaining member 38 is shaped differently than the first retaining member 32. It should be appreciated the ball feeder tube 24 is shown with two retaining members in the Figures for exemplary purposes and that the ball feeder tube 24 can include any number of retaining members, i.e., one or more retaining members, without departing from the nature of the present invention.

The retaining member 32 can be more flexible than the second retaining member 38. As such, the ball 12 can be easily pushed past the second retaining member 38 and into engagement with the retaining member 32. Alternatively, the retaining member 32 can have the same flexibility as the second retaining member 38 or less flexibility than the second retaining member 38. The combination of the retaining member 32 and the second retaining member 38 stabilizes the ball 12 in the bore 26 and reduces the likelihood that the ball 12 accidentally moves past the retaining member 32 to the wheel 16.

The retaining member 32 is spaced along the bore 26 a first distance A from the first end 28. The first distance A is shorter than the diameter D of the bore 26 so that insertion of a second ball 36 into the first end 28 at the predetermined force displaces the ball 12 toward the chute 18. The ball 12 is typically spherical and the diameter D of the bore 26 of the ball feeder tube 24 is typically only slightly larger than the diameter of the ball, as best shown in FIG. 3. As such, because the first distance A is shorter than the diameter D of the bore 26, the ball 12 extends from the first end 28 of the ball feeder tube 24 when engaged with the retaining member 32. Typically the first distance A is sized such that the ball 12 extends only slightly out of the first end 28 when engaged with the retaining member 32, i.e., so that the ball 12 is almost entirely housed in the bore 26. Accordingly, the ball 12 can be easily displaced by the insertion of a second ball 36, as set forth further below. In other words, since the ball 12 extends from the first end 28, the ball 12 is immediately displaced when a second ball 36 is inserted into the first end 28.

As set forth below, in a first embodiment, shown in FIGS. 3-7, the retaining member 32 is an elastomeric ring 40; in a second embodiment shown in FIG. 8, the retaining member 32 is a plurality resilient bristles 42; and in a third embodiment shown in FIG. 9, the retaining member 32 is an elastomeric insert 44. It should be appreciated that the first, second, and third embodiments of the retaining member 32 are shown for exemplary purposes and that the ball feeder tube 24 can include any type of retaining member without departing from the nature of the present invention. Other types of retaining members include any one or a combination of, for example, any type of protrusion, bumpers, or fingers extending into the bore 26. The retaining member 32 is typically formed of a resilient material, but could also be formed of stiff material that forms a tight fit with the ball to selectively retain the ball 12 in the ball feeder tube 24 by friction.

As set forth above, in the first embodiment shown in FIGS. 3-7, the retaining member 32 and the second retaining member 38 are elastomeric rings 40. The ball feeder tube 24 has an outer wall 46 and, for example, defines a plurality of slits 48 extending through the ball feeder tube 24. The retaining member 32 and the second retaining member 38 extend around the outer wall 46 of the ball feeder tube 24 and extend into the bore 26 through the slits 48 in the ball feeder tube 24. The ball feeder tube 24 can also define grooves 50 for positioning and retaining the retaining member 32 and the second retaining member 38 along the ball feeder tube 24. Each of the retaining member 32 and the second retaining member 38 can include any number of elastomeric rings 40.

The slits 48 are formed in a first row 52 and a second row 54 spaced from each other. The slits 48 of each row 52, 54 are spaced circumferentially about the ball feeder tube 24. The retaining member 32 extends about the outer wall 46 and extends into the bore 26 through the slits 48 of the first row 52 and the second retaining member 38 extends about the outer wall 46 and extends into the bore 26 through the slits 48 of the second row 54.

For example, the first row 52 can have fewer slits 48 than the second row 54. As one example, as shown in FIGS. 3-7, the first row 52 has two slits 48 and the second row 54 has four slits 48. Alternatively, the first row 52 can have the same number of slits 48 as the second row 54. The ball feeder tube 24 can define any number of slits 48 without departing from the nature of the present invention. Further, the ball feeder tube 24 can have any number of retaining members and the ball feeder tube 24 can define any number of rows of slits 48 without departing from the nature of the present invention.

The retaining member 32 and the second retaining member 38 of the first embodiment are typically formed of an elastomeric material that resiliently deforms in response to the predetermined force, as set forth above. For example, the retaining member 32 and the second retaining member 38 can be formed of rubber.

Figure 8:
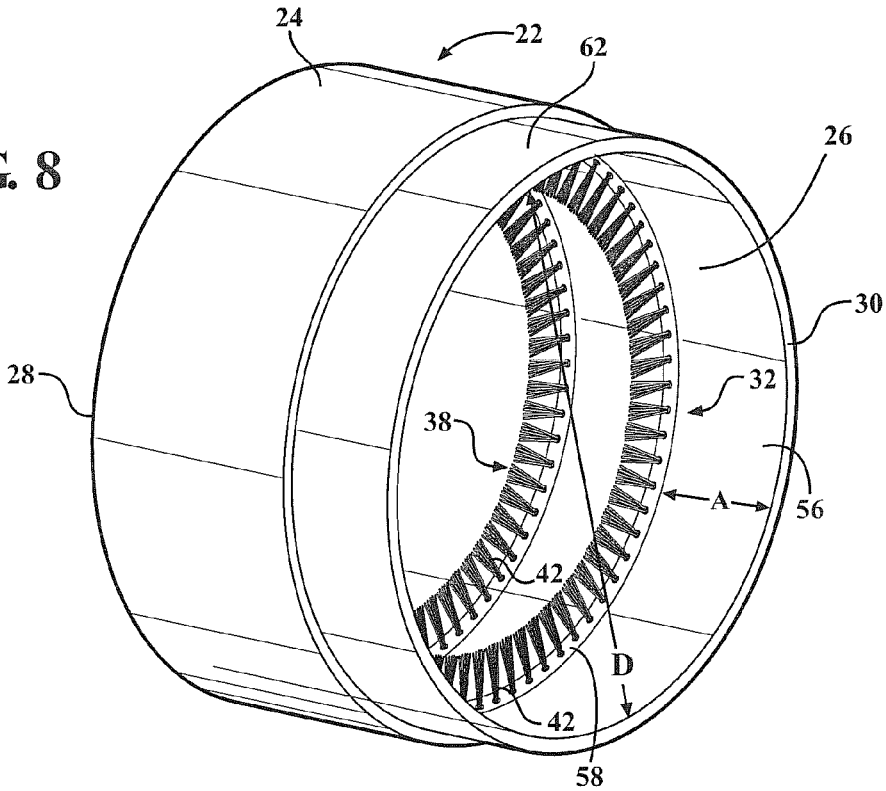
FIG. 8 is a perspective view of a second embodiment of the device.

As set forth above, in the second embodiment, the ball feeder tube 24 defines an inner wall 56 and the retaining member 32 and second retaining member 38 include bristles 42 extending from the inner wall 56, as shown in FIG. 8. The bristles 42 of the retaining member 32 are arranged in a first row 52 and the bristles 42 of the second retaining member 38 are arranged in a second row 54. The ball feeder tube 24 can include any number of rows of bristles 42 without departing from the nature of the present invention.

Typically, the each row 52, 54 of bristles 42 includes a backing 58 that is attached to the inner wall 56 of the ball feeder tube 24. The backing 58 can be, for example, adhered to the inner wall 56, or alternatively, can be attached to the inner wall 56 in any other fashion without departing from the nature of the present invention. The first row 52 and the second row 54 are each typically continuous around the bore 26 as shown in FIG. 8, i.e., the backing 58 extends entirely around the bore 26 and the bristles 42 are disposed along the backing 58 entirely around the bore 26. Alternatively, the first row 52 and the second row 54 can be discontinuous around the bore 26.

The bristles 42 of the retaining member 32 and the second retaining member 38 of the second embodiment, for example, can be synthetic, such as nylon, or can be natural such as hair or feather. The bristles 42 can be formed of any material without departing from the nature of the present invention.

As set forth above, in the third embodiment, the retaining member 32 and the second retaining member 38 are elastomeric inserts 44 extending from the inner wall 56 into the bore 26, as shown in FIG. 9. The elastomeric inserts 44 are arranged in a first row 52 and a second row 54. The ball feeder tube 24 can include any number of rows of elastomeric inserts 44 without departing from the nature of the present invention.

The elastomeric inserts 44 can be, for example, adhered to the inner wall 56, or alternatively, can be attached to the inner wall 56 in any other fashion without departing from the nature of the present invention. The first row 52 and the second row 54 are each typically discontinuous, i.e., the first row 52 and second row 54 each includes a plurality of elastomeric inserts 44 spaced around the bore 26. Alternatively, the first row 52 and the second row 54 can each include a single elastomeric insert extending continuously around the bore 26.

Figure 10A:
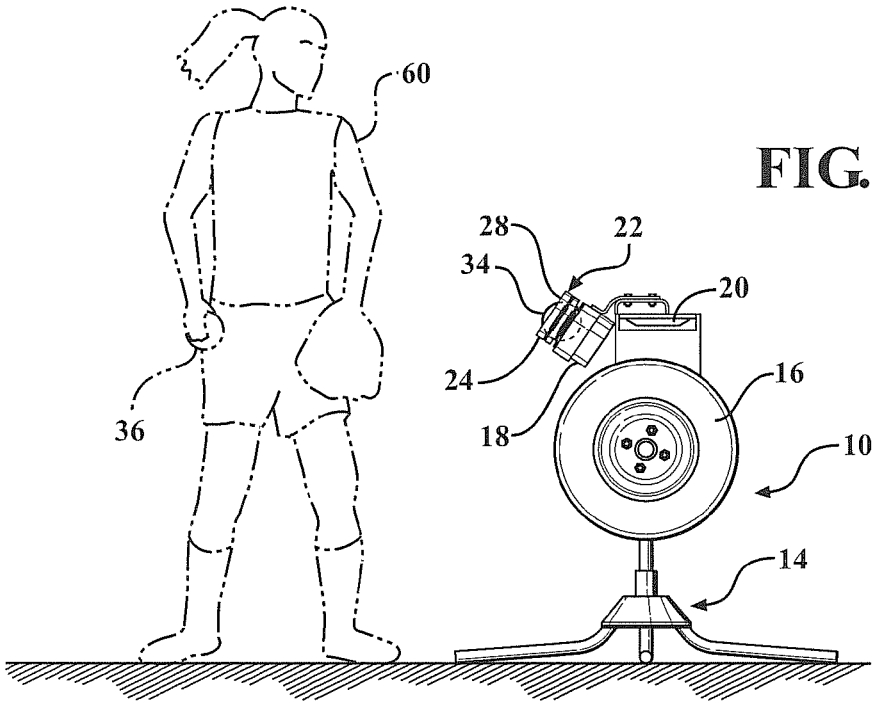
FIG. 10A is a side view of a mock pitcher using the ball pitching machine with a first ball in the device.
Figure 10B:
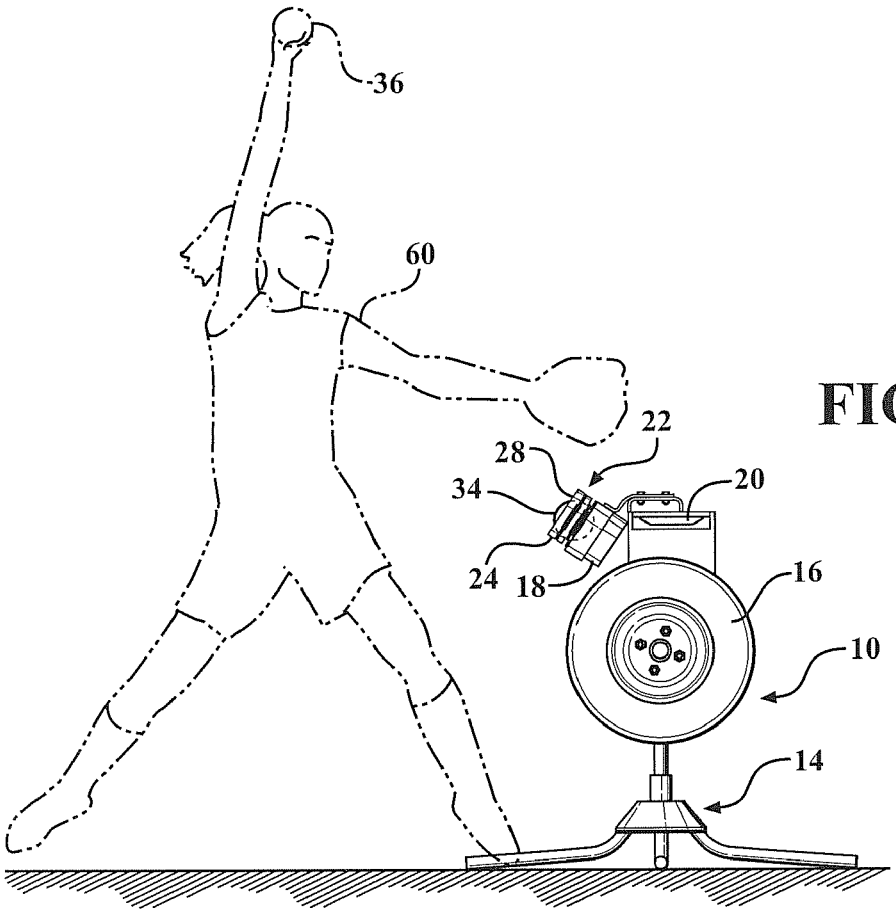
FIG. 10B is a side view of the mock pitcher moving a second ball through a simulated pitching motion.
Figure 10C:
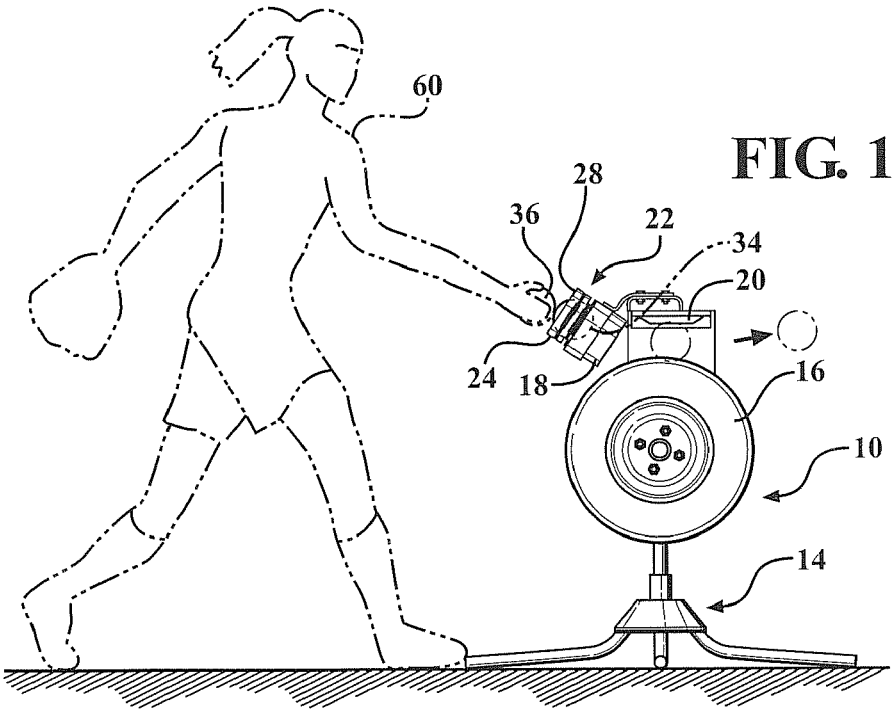
FIG. 10C is a side view of the mock pitcher inserting the second ball into the device.

With reference to FIGS. 10A-C, a mock pitcher 60 performs a method of feeding balls, specifically at least first 34 and second 36 balls, into the ball pitching machine 10. The mock pitcher 60 stands near the ball pitching machine 10 and inserts the first ball 34 in the first end 28 of the ball feeder tube 24 and into engagement with the retaining member 32. Specifically, upon initial insertion, the retaining member 32 retains the first ball 34 in the ball feeder tube 24, as shown in FIG. 10A. While holding the second ball 36, the mock pitcher 60 then moves through a simulated pitching motion to simulate the pitching motion of a pitcher in an actual game situation, as shown in FIG. 10B. The ball feeder tube 24 is positioned such that, at the end of the pitching motion, the second ball 36 held by the mock pitcher 60 is adjacent the ball feeder tube 24 and is fed into ball feeder tube 24 in a natural motion. The simulated pitching motion shown in FIGS. 10A-C is a fast pitch softball motion for exemplary purposes. The simulated pitching motion can alternatively be an overhand baseball pitching motion. The location of the ball feeder tube 24 is adjusted from that shown in FIGS. 10A-C for the overhand baseball pitching motion, as discussed below.

With reference to FIG. 10C, the mock pitcher 60 inserts the second ball 36 into the first end 28 of the ball feeder tube 24 during the simulated pitching motion to displace the first ball 34 from the retaining member 32 toward the wheel 16 to project the first ball 34 from the ball pitching machine 10. Typically, the mock pitcher 60 inserts the second ball 36 into the first end 28 at the end, or near the end, of the simulated pitching motion. The second ball 36 displaces the first ball 34 from the retaining member 32 into the chute 18 and onto the wheel 16 to deliver the first ball 34 to the batter. By inserting the second ball 36 into the first end 28, the mock pitcher 60 positions the second ball 36 into engagement with the retaining member 32 and the retaining member 32 retains the second ball 36 in the ball feeder tube 24.

The process is then repeated with a third ball (not shown). Specifically, the mock pitcher 60 moves a third ball through a simulated pitching motion and inserts the third ball into the first end 28 of the ball feeder tube 24 during the simulated pitching motion. The process can be repeated any number of times and with any number of balls.

The use of the present invention simulates an actual game situation because the mock pitcher 60 moves through the simulated pitching motion. As such, the batter is able to practice swing timing and rhythm based at least in part on the movement of the mock pitcher 60. This type of practice assists the batter in refining batting skills, which can later be translated to an actual game situation involving the actual pitching movement of an actual pitcher.

It should be appreciated that the vertical position and angle of the ball feeder tube 24 can be adjusted such that the ball feeder tube 24 is located at the end of the pitching motion of the mock pitcher 60. For example the location of the ball feeder tube 24 can be adjusted based on height differences and dominant hand preferences of different mock pitchers. The location of the ball feeder tube 24 can also be adjusted to accommodate underhand pitching motions, as typically used in softball and shown in FIGS. 10A-C, and overhand pitching motions, as typically used in baseball. In other words, for example, the simulated pitching motion can be a fast-pitch softball pitching motion, a baseball pitching motion, etc., and the location of the ball feeder tube 24 is adjusted accordingly before the simulated pitching motion. For an overhand baseball pitching motion, for example, the location of the ball feeder tube 24 is raised to be at a typical level of a baseball pitcher's hand near the end of the baseball pitcher's motion.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A ball pitching machine for propelling a ball, said ball pitching machine comprising:

a frame;

at least one wheel rotatably coupled to said frame for rotatably contacting the ball to propel the ball;

a ball feeder tube having a first end spaced from said wheel for receiving the ball and defining a bore extending from said first end toward said wheel for delivering the ball to said wheel; and a retaining member fixed relative to said ball feeder tube and extending transversely to said ball feeder tube into said bore between said first end and said wheel for selectively retaining the ball spaced from said wheel in said bore;

said retaining member being resiliently deformable toward said ball feeder tube for allowing the ball to move past said retaining member toward said wheel upon application of a predetermined force on the ball; and said retaining member being disposed circumferentially about said ball feeder tube in said bore.

2. The ball pitching machine as set forth in claim 1 further comprising a second retaining member spaced between said retaining member and said first end for selectively retaining the ball between said retaining member and said second retaining member until application of the predetermined force on the ball.

3. The ball pitching machine as set forth in claim 2 wherein said retaining member is more flexible than said second retaining member.

4. The ball pitching machine as set forth in claim 1 wherein said retaining member is an elastomeric ring.

5. The ball pitching machine as set forth in claim 4 wherein said ball feeder tube has an outer wall and defines a plurality of slits extending through said ball feeder tube and spaced circumferentially about said ball feeder tube and wherein said elastomeric ring extends about said outer wall and extends into said bore through said slits.

6. The ball pitching machine as set forth in claim 1 wherein said ball feeder tube defines an inner wall and said retaining member includes bristles extending from said inner wall.

7. The ball pitching machine as set forth in claim 1 further comprising a chute extending between said ball feeder tube and said wheel for delivering the ball from said ball feeder tube to said wheel wherein said ball feeder tube is removeably engaged with said chute so that said ball feeder tube can be selectively engaged with said chute to retrofit said chute.

8. The ball pitching machine as set forth in claim 7 wherein said ball feeder tube includes a second end spaced from said first end and configured to removeably engage said chute.

9. The ball pitching machine as set forth in claim 1 wherein said bore of said ball feeder tube has a diameter and said retaining member is spaced along said bore a first distance from said first end and wherein said first distance is shorter than said diameter of said bore so that insertion of a second ball into the first end at the predetermined force displaces the ball toward the chute.

10. A device for attachment to a chute of a ball pitching machine for selectively retaining a first ball and selectively delivering the first ball to the chute, said device comprising:

a ball feeder tube having a first end for receiving the first ball and a second end for attachment to the chute;

said ball feeder tube defining a bore having a diameter and extending from said first end to said second end for delivering the first ball to the chute; and a retaining member fixed relative to said ball feeder tube and extending transversely to said ball feeder tube into said bore between said first end and said second end for selectively retaining the first ball in said bore;

said retaining member being resiliently deformable toward said ball feeder tube for allowing the first ball to move past said retaining member toward the chute upon application of a predetermined force on the first ball;

said retaining member being spaced along said bore a first distance from said first end wherein said first distance is shorter than said diameter of said bore so that insertion of a second ball into the first end with the predetermined force displaces the first ball toward the chute.

11. The device as set forth in claim 10 further comprising a second retaining member spaced between said retaining member and said first end for selectively retaining the first ball between said retaining member and said second retaining member until application of the predetermined force on the first ball.

12. The device as set forth in claim 11 wherein said retaining member is more flexible than said second retaining member.

13. The device as set forth in claim 10 wherein said retaining member is disposed circumferentially about said ball feeder tube in said bore.

14. The device as set forth in claim 10 wherein said retaining member is an elastomeric ring.

15. The device as set forth in claim 14 wherein said ball feeder tube has an outer wall and defines a plurality of slits extending through said ball feeder tube and spaced circumferentially about said ball feeder tube and wherein said elastomeric ring extends about said outer wall and extends into said bore through said slits.

16. The device as set forth in claim 10 wherein said ball feeder tube defines an inner wall and said retaining member includes bristles extending from said inner wall.

17. A method of feeding a ball into a ball pitching machine having a rotatable wheel, a ball feeder tube having a first end spaced from the wheel, and a retaining member fixed relative to the ball feeder tube between the first end and the wheel, said method comprising:

inserting a first ball into the first end of the ball feeder tube and into engagement with the retaining member;

moving a second ball through a simulated pitching motion;

inserting the second ball into the first end of the ball feeder tube during the simulated pitching motion to displace the first ball from the retaining member toward the wheel to project the first ball from the ball pitching machine.

18. The method as set forth in claim 17 further comprising positioning the second ball into engagement with the retaining member and moving a third ball through a simulated pitching motion and inserting the third ball into the first end of the ball feeder tube during the simulated pitching motion.

19. The method as set forth in claim 17 wherein the simulated pitching motion is further defined as fast-pitch softball pitching motion.

* * * * *